United States Patent [19]

Kajikawa et al.

[11] Patent Number: 4,872,930

[45] Date of Patent: Oct. 10, 1989

[54] METHOD FOR MANUFACTURING CARPET TILES HAVING EXCELLENT DIMENSIONAL STABILITY

[75] Inventors: Teruo Kajikawa, Yokosuka; Toshio Yoshino, Zama, both of Japan

[73] Assignee: Nippon Oil Co., Ltd., Japan

[21] Appl. No.: 147,034

[22] Filed: Jan. 19, 1988

Related U.S. Application Data

[63] Continuation of Ser. No. 752,891, Jul. 8, 1985, abandoned.

[30] Foreign Application Priority Data

Jul. 9, 1984 [JP] Japan ..... 59-142035

[51] Int. Cl.[4] ..... B32B 31/08; B32B 31/12; B32B 31/30

[52] U.S. Cl. ..... 156/72; 156/305; 156/324; 156/333; 156/337

[58] Field of Search ..... 156/72, 313, 324, 305, 156/308.2, 309.6, 327, 333, 334, 337, 164

[56] References Cited

U.S. PATENT DOCUMENTS

| | | | |
|---|---|---|---|
| 2,521,831 | 9/1950 | Cone et al. | 156/305 |
| 3,728,182 | 4/1973 | Wisotzy | 156/72 |
| 3,925,130 | 12/1975 | Brown | 156/305 |
| 4,096,308 | 6/1978 | Reed | 156/164 |
| 4,576,665 | 3/1986 | Machell | 156/72 |

FOREIGN PATENT DOCUMENTS

| | | | |
|---|---|---|---|
| 49-18108 | 2/1974 | Japan . | |
| 53-46220 | 4/1978 | Japan . | |
| 0113533 | 9/1980 | Japan | 156/72 |
| 1432781 | 4/1976 | United Kingdom . | |

*Primary Examiner*—George F. Lesmes
*Assistant Examiner*—J. Davis
*Attorney, Agent, or Firm*—Ostrolenk, Faber, Gerb & Soffen

[57] ABSTRACT

The present invention relates to a method for manufacturing carpet tiles having excellent dimensional stability which comprises the steps of:

(a) allowing a reticulated fabric base having a small thermal coefficient of linear expansion to be contact with the whole surface of the back of a carpet base material, (b) applying a backing material prepared from a composition containing a thermoplastic material as the major component to the resulting composite material, and (c) optionally laminating a fabric backing onto the above backing material.

5 Claims, 1 Drawing Sheet

METHOD FOR MANUFACTURING CARPET TILES HAVING EXCELLENT DIMENSIONAL STABILITY

This is a continuation of application Ser. No. 752,891, filed July 8, 1985 and now abandoned.

BACKGROUND OF THE INVENTION (1) Field of the Invention

This invention relates to a method for manufacturing carpet tiles exhibiting very small dimensional instability with respect to changes in ambient temperature.

(2) Description of the Prior Art

Carpet tiles are pieces of carpet in the shape of a square, rectangle, rhombus or the like or of a more complicated shape, having an area of, for example, 0.05 to 2 $m^2$. Such carpet tiles may be positioned next to each other to closely cover a floor. Carpet tiles have an advantage over ordinary carpets in that they may be easily laid on floor by merely placing the carpet tiles side by side and fixing them. Carpet tiles also have the merit that they can provide a variety of visual impressions by using different combinations of shape and color, and the repair thereof is easy. In cases where the carpet tiles are laid on the floor, it is required that they adhere sufficiently to the floor so that no portion thereof slips from its appropriate position when one walks thereon. In this connection, carpet tiles are known which may be fixed by their own weight, such carpet tiles being designed to have a sufficient weight for flexibility (self-fixing) by comprising a relatively thick backing material.

Backing materials for carpet tiles serve also for providing fiber-shedding prevention, shape retaining performance, fitness onto floor and other various properties to the carpet tiles.

A conventional carpet tile has generally a construction in which a backing material is laminated on a carpet based material, and onto which a fabric backing is further optionally attached. There is also the case where an adhesive is used for fixing pile yarns of such carpet base material, or the case where no fabric backing is employed.

While conventional carpet tiles have the various advantages described above, there is also a disadvantage in that the dimension of such a conventional carpet tile changes slightly with changes in temperature due to changing of the seasons or rapid change in temperature due to air-conditioner. Since the carpet tile self-fixing characteristic property is its own weight, such carpet tiles have been usually applied without utilizing any adhesive means. For this reason, conventional carpet tiles have had the disadvantage in that if there is a significant change in temperature, considerable deformation is observed in a large area of application, even though there is a slight change in the dimension of a piece of carpet tile. In other words, when the temperature dropped remarkably, gaps appear between the respective carpet tiles due to slight shrinkage of them, so that it mars the beauty thereof, or the feel in case of walking on such shrunk carpet tiles becomes uncomfortable because these carpet tiles may slip out of place against one another at the time of such walking. On the contrary, when the temperature rises significantly, there is also the where bulges (swellings) are produced on the carpet tiles due to swelling thereof. It may be said that the most significant disadvantage of carpet tiles is the dimensional change thereof as a result of change in temperature as described above, so that immediate solution of such problem has been required.

OBJECT OF THE INVENTION

It is an object of the present invention to eliminate the above-mentioned disadvantages involved in conventional carpet tiles and to provide carpet tiles having excellent dimensional stability.

SUMMARY OF THE INVENTION

The present invention relates to a method for manufacturing carpet tiles having excellent dimensional stability characterized by the steps of:

(a) allowing a reticulated fabric base having a small thermal coefficient of linear expansion to be contact with the whole surface of the back of a carpet base material, (b) applying a backing material prepared from a composition containing a thermoplastic material as the major component to the resulting composite material, and (c) optionally laminating a fabric backing onto said backing material.

DETAILED DESCRIPTION OF THE INVENTION

Figure 1:
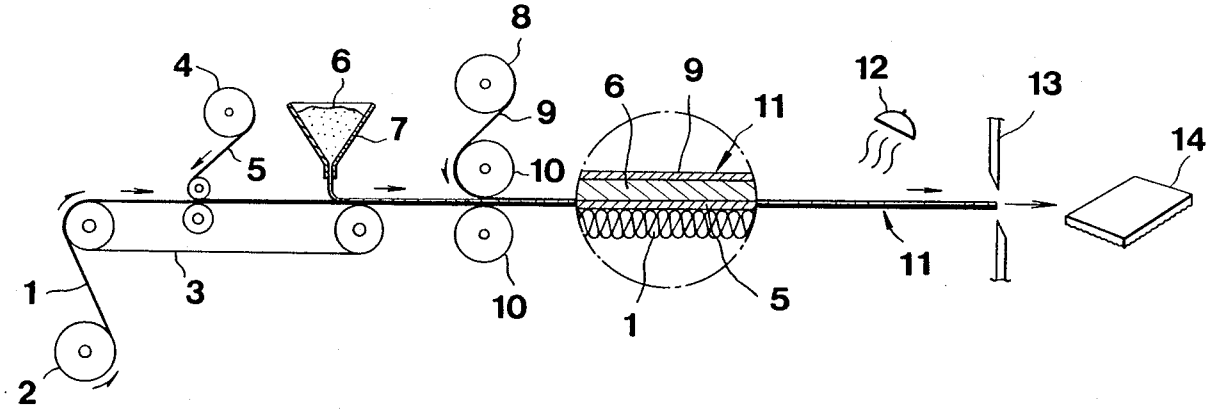
FIG. 1 is a schematic view illustrating an example of the method for manufacturing carpet tiles according to the present invention

The carpet base materials in the present invention are not specifically limited, but they may be woven carpets, knitted carpets, tufted carpets, needle-punched carpets and the like prepared from natural fibers such as wool, cotton, hemp or the like, synthetic fibers such as polypropylene, polyester, polyamide, polyacrylate, polyvinylidene chloride or the like, and other fibrous materials of flat yarn, and among others tufted carpets and needle-punched carpets can be preferably used. Additionally, materials obtained by subjecting these carpet base materials to a precoating treatment with latex system, a hot-melt adhesive of ethylene-vinyl acetate copolymer system, and a low-density polyethylene film may also be utilized.

The reticulated fabric base used in the present invention is one having a small thermal coefficient of linear expansion ($10^{-5}$ or less, and preferably $10^{-6}$ or less) and an opening ratio required for passing a backing material therethrough. Such fabric bases include woven fabrics obtained through plain, twill, figure, or leno weaving etc. of bundled yarn, fabrics which are prepared from bundled yarn by binding the same in a network without weaving, and nonwoven fabrics prepared by dispersing fibers at random with a uniform thickness and binding the fibers with the use of a binder. Particularly suitable for the present invention are plane weave fabric and fabric prepared by binding bundled yarn with a binder in a network without any weaving, and one, two or more pieces of such fabrics lying one upon another.

The opening ratio of such fabric base is 20% or more and preferably 25% or more, and a preferable diameter of such opening is 1.0 mm or more. The material of said fabric base is not particularly limited, and examples include glass fiber, carbon fiber and metallic fiber, among others, glass fiber being preferably used.

The backing material used in the present invention is prepared from a composition containing a thermoplastic material as the major component. Examples of such thermoplastic material include asphalt such as natural asphalt, petroleum asphalt or the like, polyolefins such as polyethylene, polypropylene, ethylene-propylene copolymer, ethylene-butene copolymer and the like, olefin-polar monomer copolymers such as ethylene-vinyl acetate copolymer, ethylene-acrylic ester copolymer and the like, and chlorinated polymers such as polyvinyl chloride, polyethylene chloride and the like.

When using asphalt as the backing material in the present invention, 50–90% by weight of the asphalt may be incorporated 10–50% by weight of polyolefin such as polyethylene, polypropylene, ethylene-propylene copolymer, ethylene-butylene copolymer or the like, ethylene-polar monomer copolymer such as ethylene-vinyl acetate copolymer, ethylene-acrylic ester copolymer or the like, chlorinated polymer such as polyvinyl chloride, chlorinated polyethylene or the like, or synthetic or natural rubber such as styrene-butadiene (random, block) copolymer, styrene-isoprene (random, block) copolymer, butyl rubber, isoprene rubber, chloroprene rubber or the like, and, if necessary, any inorganic filler.

Furthermore, when using a polyolefin, into 50–95% by weight of the polyolefin may be incorporated 5–50% by weight of wax, a low molecular weight polyolefin, petroleum resin and inorganic filler. Furthermore, where a ethylene-polar monomer copolymer system material is employed, into 10–90% by weight of the copolymer may be incorporated 10–85% by weight of an inorganic filler, 0–20% by weight of a softener and/or a plasticizer which is in liquid state at normal temperature.

Where a chlorinated polymer is employed, with 10–90% by weight of the chlorinated polymer may be incorporated 5–80% by weight of a plasticizer and 0–80% by weight of an inorganic filler.

If an asphalt, polyolefin, or ethylene-polar monomer copolymer system material is utilized in the present invention, the backing material may be prepared by means of kneader, Banbury mixer, single or twin screw kneading extruder. The resulting composition is applied as first and second backing materials such that the total amount of them becomes 1.5–8.0 kg/m$^2$, and preferably 2.0–6.0 kg/m$^2$. When such total amount of the backing material is less than 1.5 the, self-fixing ability of the resulting carpet tile by its own weight becomes poor so that it is not suitable. On the other hand, when the total amount of the backing material is higher than 8.0 kg/m$^2$, laying the resulting carpet tile on a floor becomes difficult and economically disadvantageous.

Furthermore, in case of a chlorinated polymer, a paste is prepared from polyvinyl chloride plasticizer (e.g., DOP) and an inorganic filler, and such paste may be applied to a carpet base material with an amount of 1.5–8.0 kg/m$^2$, The fabric backings of the present invention may be woven fabrics, bound fabrics or nonwoven fabrics prepared from plyester, polyamide, polypropylene, or glass fibers, and those having a unit weight of 10–500 g/m$^2$ and preferably 15–400 g/m$^2$ may be utilized as the occasion demands. The case where such fabric backings are required is one where the backing material is a composition containing asphalt as the major component, or one where there is required more precisely control of dimensional change of the tile to permit such carpet tiles to be used in such places where changes in temperature is particularly remarkable. In the case when a woven, bound or nonwoven fabric prepared from glass fiber is used as the fabric backing, it is necessary to selecting a fabric backing having a lower unit weight than that of a reticulated fabric base produced from said glass fiber. If a fabric backing of a high unit weight is selected, the resulting carpet tile is curved towards the carpet base material so that there is a danger of stumbling and a fear of spoiling the appearance.

Next, the method for manufacturing carpet tiles having excellent dimensional stability according to the present invention will be described hereinbelow.

FIG. 1 is a schematic view illustrating an example of the method for manufacturing carpet tiles in accordance with the present invention wherein a reticulated fabric base 5 guided from a reticulated fabric base supplying section 4 is laminated on a carpet base material 1 withdrawn from a carpet base material supplying section 2 and caused to travel by means of a conveyor 3 so as to be in contact with the whole surface of the carpet base material 1. A backing material 6 made of a composition (except a pasty composition of polyvinyl chloride) containing a thermoplastic material as the major component is subjected to T-die extrusion at a temperature of 100°–250° C., and such extruded backing material is applied to the resulting composite material of the carpet base material 1 and the fabric base 5 in an amount of 1.5–8.0 kg/m$^2$ at a temperature of 100°–250° C. by means of a doctor blade or a coater 7, such as calender roll coater or the like. Thereafter a fabric backing 9 is guided to the upper surface of said backing material 6, in parallel thereto, from a fabric backing supplying section 8 and optionally laminated thereon by the use of a pressure rollers 10 to form a laminated carpet sheet material 11 having prescribed thickness and. The carpet sheet material 11 is passed through a cooling means 12 and finally the desired carpet tile 14 is obtained by cutting with a cutting means 13.

When the backing material is made of a composition containing polyvinyl chloride, a paste prepared from polyvinyl chloride, a plasticizer and an inorganic filler is homogeneously applied to the composite material of said carpet base material and reticulated fabric base in an amount of 1.5–8.0 kg/m$^2$ at ordinary temperature by utilizing a doctor blade, and if necessary, a fabric backing is laminated thereon, and the resulting laminated material is heated at 150°–220° C. for 5–20 minutes to obtain gelation of such material, thereby obtaining an integrated carpet sheet material. Alternatively, a pasty composition of the polyvinyl chloride system may be homogeneously spread over a fabric backing or conveyor, on which a reticulated fabric base and a carpet base material are laminated, and they may be similarly heated to obtain gelation thereof. Then, the resulting carpet sheet material is cut out in a prescribed dimension to obtain carpet tiles.

It has been found that when the reticulated fabric base used in the present invention is inserted in the backing material so as to be in contact with the carpet base material, the resulting carpet tile has excellent dimensional stability. More specifically, the reticulated fibers used in this invention has a very small thermal coefficient of linear expansion which is far smaller than those of carpet base materials, backing materials and fabric backings which have been hitherto utilized for carpet tiles. Thus, when the reticulated fabric base of the present invention is employed in combination with other materials, the dimensional change of the resulting carpet tile becomes very small in response to change in temperature. For this reason, it is very useful for improving dimensional stability of the carpet tile that the reticulated fabric base according to the present invention is in contact with such backing material as described above. Another reason for utilizing the reticulated fabric base in the present invention resides in that a backing material is allowed to be contact with a carpet base material through the network of the reticulated fabric base. In this respect, if a fabric base having no network therein is used, a backing material cannot serve to insert the fabric base thereinto, otherwise the backing material is divided in two layers for its use. In the reticulated fabric base according to the present invention, however, there is the advantage is achieved without any division of the backing material.

EXAMPLES

The present invention will be described in more detail hereinbelow in conjunction with examples and comparative examples.

EXAMPLES 1-7

Various carpet tiles were prepared in such a manner that a reticulated fabric base prepared from glass fiber was superposed on the back of a tufted or needle punched carpet, to which each of various backing materials was applied as shown in Table 1, and a fabric backing was optionally laminated thereon.

With respect to these various carpet tiles, the ratio of dimensional change was determined in such a way that changes in dimension of the carpet tiles were measured where the temperature is higher or lower by 40° C. than room temperature of 20° C. The results are shown in Table 1, and as is apparent therefrom, the ratios of dimensional change were very small and this means good dimensional stability. Thus, carpet tiles having no problem from a practical point of view were obtained in accordance with the present invention.

TABLE 1

| Example | 1 | 2 | 3 | 4 | 5 | 6 | 7 |
|---|---|---|---|---|---|---|---|
| Carpet Base Material | | | | | | | |
| Type | Tufted Carpet | Needle-Punched Carpet | Tufted Carpet | Tufted Carpet | Needle-Punched Carpet | Tufted Carpet | |
| Yarn Material | Acrylic | PP | Nylon | PP | PP | Wool | |
| Fabric Base Material | PP Woven Fabric | PP Nonwoven Fabric | Polyester Non-woven Fabric | Polyester Non-woven Fabric | PP Nonwoven Fabric | Polyester Non-Woven Fabric | |
| Unit Weight ($g/m^2$) on Fabric Base | 120 | (total) 1,000 | 100 | 100 | (Total) 800 | 100 | |
| (a) Glass Reticulated Fabric Base | | | | | | | |
| Weave | Plain Weave | Nonwoven Fabric | Plain Weave | Plain Weave | Bound Reticulated Fabric without Weaving | Plain Weave | Bound Reticulated Fabric without Weaving |
| Unit Weight ($g/m^2$) | 225 | 60 | 55 | 340 | 73 | 760 | 32 × 2 pieces |
| Thickness of Bundled Yarn (mm) | 0.30 | (Aperture having 5 mm diameter, 125/square inch) | 0.08 | 0.36 | 0.20 | 1.0 | 0.20 |
| Density of Bundled Yarn (number/inch) | 16 | | 20 | 16 | 10 | 18 | 5 × 2 pieces |
| Opening Ratio | about 6/7 | about 8/9 | about 19/20 | about 5/6 | about 14/15 | about 8/9 | about 14/15 |
| (b) Backing Material | | | | | | | |
| Type | Asphalt System | LDPE System | EVA System | EVA System | EEA System | PVC System | Asphalt System |
| Composition % | (40–60 Straight Asphalt 70 EVA 30 (VA 8%, MI 15) | (LDPE 80 (MI 40) Calcium Carbonate 20) | (EVA 40 (VA 26%, MI 8) DOP 10 Calcium Carbonate 50) | (EVA 30(VA 28%, MI 4) DOP 10 Calcium Carbonate 60 | (EEA 40 (EA 20%, MI 4) Processing Oil Calcium Carbonate 50) | (PVC 20 DOP 25 Calcium Carbonate 55) | (10–20 Blown Asphalt 75 TPR 25) |
| Unit Weight ($g/m^2$) | 3.0 | 3.5 | 4.0 | 5.0 | 4.0 | 4.5 | 3.0 |
| (c) Fabric Backing | | | | | | | |
| Material | Polyester Nonwoven Fabric | None | Polyester Nonwoven Fabric | Glass Non-Woven Fabric | None | Polyester Nonwoven Fabric | Nylon Non-Woven Fabric |
| Unit Weight ($g/m^2$) | 90 | | 70 | 25 | | 100 | 120 |
| Outline of Manufacturing Method | Heat-fused at 160° C., Lamination by Doctor | Heat-fused at 200° C., Lamination by T-die | ← | ← | ← | Lamination by Doctor Blade Coating. Heating | Heat-fused at 180° C., Lamination by Doctor |

TABLE 1-continued

| Example | 1 | 2 | 3 | 4 | 5 | 6 | 7 |
|---|---|---|---|---|---|---|---|
| | Blade Coating | Extrusion | | | | at 180° C. for 15 min. to perform Gelation | Blade Coating |
| Dimensional Stability | | | | | | | |
| Ratio of Dimentional Change (%) | | | | | | | |
| Rise 40° C. | | | | | | | |
| Length | +0.06 | +0.10 | +0.07 | +0.04 | +0.09 | +0.05 | +0.08 |
| Breadth | +0.07 | +0.14 | +0.07 | +0.05 | +0.09 | +0.06 | +0.09 |
| Drop 40° C. | | | | | | | |
| Length | −0.08 | −0.11 | −0.08 | −0.05 | −0.09 | −0.06 | −0.08 |
| Breadth | −0.08 | −0.15 | −0.09 | −0.05 | −0.10 | −0.07 | −0.10 |

COMPARATIVE EXAMPLES 1-5

Various carpet tiles were prepared in such a manner that each of various backing materials as shown in FIG. 2 was applied to the back of a taffetized carpet without employing a reticulated fabric base prepared from glass fiber, and a fabric backing was optionally laminated thereon.

With respect to these various carpet tiles, each ratio of dimensional change was determined in such a way that changes in dimension of a carpet tile were measured where the temperature is higher or lower by 40° C. than room temperature of 20° C. The results are shown in Table 2, and as is apparent therefrom, the ratios of dimensional change were very large so that there might be problems from practical point of view. Each raw material for the backing materials will be abbreviated herein as follows.

Ethylene-vinyl acetate copolymer: EVA
Ethylene-ethyl acrylate copolymer: EEA
Polypropylene: PP
Low-density polyethylene: LDPE
Polyvinyl chloride: PVC
Dioctyl phthalate: DOP
Styrene-butadiene block copolymer: TPR

TABLE 2

| Comparative Example | 1 | 2 | 3 | 4 | 5 |
|---|---|---|---|---|---|
| Carpet Base Material | | | | | |
| Type | Tufted Carpet | | | | |
| Yarn Material | Nylon | | | | |
| Fabric Base Material | Polyester Nonwoven Fabric | ← | ← | ← | ← |
| Unit Weight ($g/m^2$) on Fabric Base | 100 | | | | |
| (a) Glass Reticulated Fabric Base | None | ← | ← | ← | ← |
| (b) Backing Material | | | | | |
| Type | Asphalt system | LDPE System | EVA System | EEA System | PVC System |
| Composition (%) | (40-60 Straight Asphalt 70 EVA 30 (VA 8%, MI 15)) | (LDPE (MI 10) 80 Calcium Carbonate 20) | (EEA 40 (VA 26%, MI 8) DOP 10 Calcium Carbonate 50) | (EEA 40 (EA 20%, MI 4) DOP 10 Calcium Carbonate 50) | (PVC 20 DOP 25 Calcium Carbonate 55) |
| Unit Weight ($kg/m^2$) | 3.0 | 3.5 | 4.0 | 4.0 | 4.5 |
| (c) Fabric Backing | | | | | |
| Material | Polyester Nonwoven Fabric | None | None | Polyester Nonwoven Fabric | Polyester Nonwoven Fabric |
| United Weight ($g/m^2$) | 70 | | | 50 | 50 |
| Outline of Manufacturing Method | Heat-fused at 170° C., Lamination by Doctor Blade Coating | Heat-fused at 200° C., Lamination by T-die Extrusion | Heat-fused at 200° C. Lamination by T-die Extrusion | Heat-fused at 190° C., Lamination by T-die Extrusion | Lamination by Doctor Blade Coating, Heating at 180° C. for 15 min. to perform Gelation |
| Dimensional Stability | | | | | |
| Ratio of Dimensional | | | | | |

TABLE 2-continued

| Comparative Example | 1 | 2 | 3 | 4 | 5 |
|---|---|---|---|---|---|
| Change (%) Rise 40° C. | | | | | |
| Length | +0.40 | +0.43 | +0.44 | +0.42 | +0.40 |
| Breadth | +0.47 | +0.61 | +0.60 | +0.50 | +0.49 |
| Drop 40° C. | | | | | |
| Length | −0.40 | −0.47 | −0.45 | −0.44 | −0.42 |
| Breadth | −0.50 | −0.62 | −0.60 | −0.55 | −0.50 |

What is claimed is:

1. A method for manufacturing carpet tiles having excellent dimensional stability comprising the steps of:

(a) allowing a reticulated glass fiber base having a small thermal coefficient of linear expansion and an opening ratio of 33 to 95% and a unit weight of 73 to 225 g/m$^2$ to contact with the whole surface of the back of a tufted or needle-punched carpet base material in order to form a composite material, and, (b) thermally melting a backing material prepared from a composition containing as the major component, a thermoplastic material selected from the group consisting of asphalt, polyolefin and olefin-polar monomer copolymer, and applying the melted material to the composite material on the side of the reticulated fabric base thereof by T-die extrusion.

2. A method for manufacturing carpet tiles having excellent dimensional stability comprising the steps of:

(a) allowing a reticulated glass fiber base having a small thermal coefficient of linear expansion, an opening ratio of 33 to 95% and a unit weight of 73 to 225 g/m$^2$ to contact with the whole surface of the back of a tufted or needle-punched carpet base material in order to form a composite material, (b) thermally melting a backing material prepared from a composition containing as the major component, a thermoplastic material selected from the group consisting of asphalt, polyolefin and olefin-polar monomer copolymer, and applying the melted material to the composite material on the side of the reticulated fabric base thereof by T-die extrusion and (c) laminating a fabric backing onto the applied surface of the composite material.

3. A method for manufacturing carpet tiles as claimed in claim 2 wherein said fabric backing is a woven, bound or nonwoven fabric prepared from a polyester, polyamide, polypropylene or glass fiber, having a unit weight within a range of 10–500 g/m$^2$.

4. A method for manufacturing carpet tiles as claimed in claim 2 wherein said backing material is applied so as to obtain 1.5 to 8 kg of backing material per square meter of composite material.

5. A method of manufacturing carpet tiles as claimed in claim 4 wherein said backing material is applied so as to obtain 2 to 6 kg of backing material per square meter of composite material.

* * * * *